United States Patent [19]

Hahn et al.

[11] 3,981,456

[45] Sept. 21, 1976

[54] FOOD PARTICLE MACERATING MEANS

[75] Inventors: Thomas M. Hahn, Louisville; George T. Sholtes, Fern Creek, both of Ky.

[73] Assignee: General Electric Company, Louisville, Ky.

[22] Filed: Oct. 31, 1975

[21] Appl. No.: 627,603

[52] U.S. Cl. ..... 241/46 R; 241/185 A; 415/121 B; 415/121 G

[51] Int. Cl.[2] ..... B02C 13/10; F04D 29/70

[58] Field of Search ..... 241/46 R, 84, 101.2, 241/101.5, 185 A; 415/121 B, 121 G

[56] References Cited

UNITED STATES PATENTS

| | | | |
|---|---|---|---|
| 2,583,997 | 1/1952 | Chester | 415/121 B |
| 3,244,376 | 12/1965 | Schade | 415/121 B |
| 3,434,671 | 3/1969 | Cushing et al. | 241/46 R |

*Primary Examiner*—Granville Y. Custer, Jr.
*Attorney, Agent, or Firm*—Francis H. Boos

[57] ABSTRACT

A pump and motor assembly for a dishwasher including a food particle macerating means having a cutting arm attached to a helically-wound column. The cutting arm coacts with a grid-like grading element to macerate food particles to reduce them to a size where they will be removed in fluid suspension with an initial rinse liquid in the dishwasher. The food particle macerating device is capable of riding over or slipping around unmacerable food particles, such as particles of bone, without damage to itself or to associated elements of the pump-motor assembly. The macerating device further serves to dislodge unmacerable particles from the grading element, urging them into a trap provided for their collection.

3 Claims, 4 Drawing Figures

FOOD PARTICLE MACERATING MEANS

BACKGROUND OF THE INVENTION

This invention relates generally to a pump and motor assembly for circulating a wash liquid in a dishwasher. More specifically, the invention relates to a pump and motor assembly having a food macerating device which causes food waste particles to be cut to a size such that they will be suspended in a rinse liquid and carried from the dishwasher during various initial rinse cycles. The food macerating device, in large measure, obviates the need for a fine screen or the like to filter the wash liquid.

One previous attempt at providing such a device is shown in U.S. Pat. No. 3,434,671. This device proved to be complicated and difficult to assemble and, in addition, tended to cover an irregular pattern on the face of an associated grid-like grading element. Thus, under heavy food soil conditions, the macerating element was ineffectual in keeping the grading element from becoming obstructed. The present invention provides a full 360° sweep across the grading element to prevent the food waste material from obstructing wash liquid flow. It further avoids the possibility that moving parts on particle cutting arms associated with the macerating assembly could, themselves, become jammed with food particles and thereby define an irregular pattern on the grading element. The macerating assembly of this invention is a simple, straightforward, inexpensively-constructed, and readily-maintained device which improves the efficiency of a macerating assembly in a dishwasher pump and motor assembly.

SUMMARY OF THE INVENTION

The present invention is a pump and motor assembly for a dishwasher which includes a food macerating arrangement which comminutes food particles to a size which allows them to be carried out of the dishwasher with the outgoing wash liquid. As is customary in automatic dishwashers, there are several initial rinse cycles which serve to remove a major portion of the food waste particles from the dishes to be cleaned. It is during these initial cycles, that the food macerating arrangement serves its most important function, namely that of reducing food particles to a small size so that they can be carried away and do not remain in the automatic dishwasher during the extended wash cycles thereafter. The food macerating arrangement of this invention further serves to subdivide the food waste particles so that, as they are circulated, they are finely divided and thus do not plug the spray orifices in the various wash arms located within the dishwasher. More specifically, the invention includes a pump and motor assembly for use with a dishwasher comprising a pump housing having an inlet and an outlet and a rotatable shaft having an impeller for rotation within the housing at a preselected location to provide for pumping of fluid from the inlet toward the outlet; a grid-like food particle grading element disposed across the inlet and having a plurality of openings through which fluid entering the inlet must pass to reach the impeller; a food particle cutter attached to the shaft and including a cutting arm mounted on a flexible, helically-wound column, the arm being rotatable about the axis and the column being flexibly expandable to provide for the arm to pass over an unmacerable food particle lodged in one of the openings of the grading element.

The present invention has been found to be useful in removing a major portion of the food waste particles during the initial rinse portions of the wash cycle of an automatic dishwasher.

DESCRIPTION OF THE PREFERRED EMBODIMENT

Figure 1:
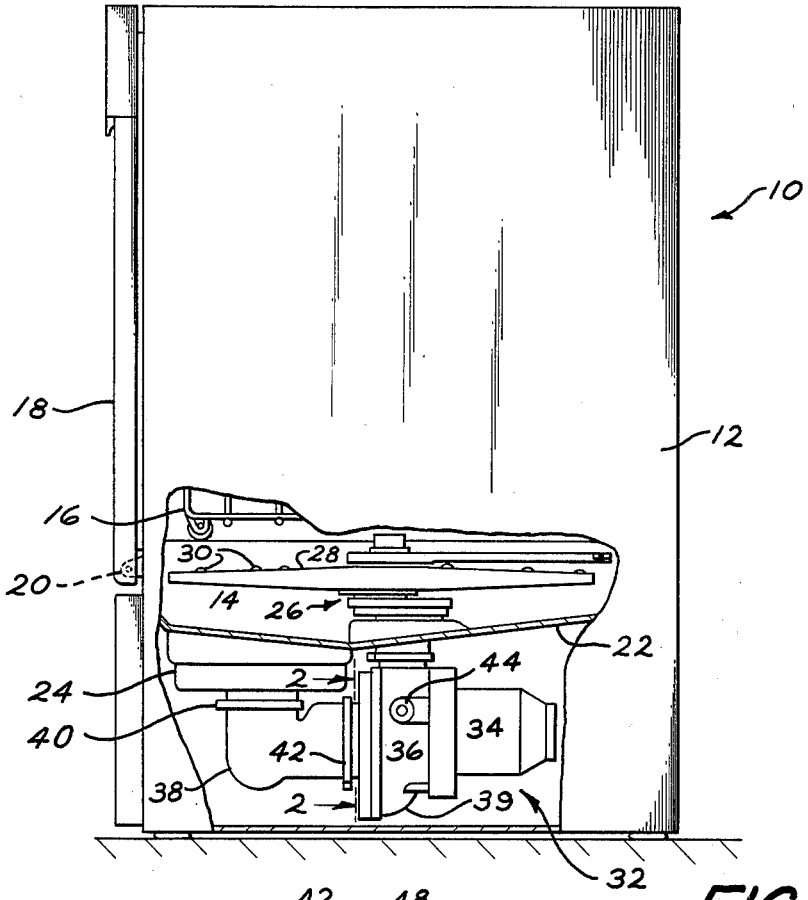
FIG. 1 is an elevational view, partially cut away, showing a dishwasher employing the present inventon.

Referring to FIG. 1, there is shown an automatic dishwasher 10 having an outer cabinet 12 defining therein a wash chamber 14. Within chamber 14 is a dish-supporting rack 16 adapted to receive and support dishes or other articles to be washed by the dishwasher. A door 18 is provided in one wall of cabinet 12 pivotable about a hinge 20 to provide access to wash chamber 14.

The lower extremity of wash chamber 14 is defined by a bottom wall 22 which gradually slopes to allow water to flow to the lowest extremity thereof. Disposed at this lowest extremity is a sump 24 which may be formed integrally with bottom wall 22 or which may be a separate element secured to an orifice edge in bottom wall 22. Projecting upwardly from bottom wall 22, near the center of wash chamber 14, is a spray means 26 which includes a rotatable arm 28. Rotatable arm 28 includes a plurality of projections 30 having orifices located therein through which wash fluid is ejected to effectuate a wash action upon articles supported by rack 16. At least one of these orifices is directed such that a reaction force will be created by the wash fluid passing therethrough and thereby rotate arm 28.

Wash fluid is propelled into spray means 26 by a motor-pump assembly 32 including an electric motor 34 and a pump 36. A flexible boot or conduit 38 interconnects sump 24 with the inlet of pump 36. Conduit 38 is secured to sump 24 by means of a clamp 40 and is secured to pump 36 similarly by means of a clamp 42. Motor pump assembly 32 is supported from bottom wall 22 in any suitable fashion as is known in the art.

An electrically operated solenoid (not shown) operates a valve within the housing of pump 36 to direct the wash fluid either upwardly through spray means 26 or out through an effluent discharge conduit 44. The operation of the automatic dishwasher 10 is accomplished by virtue of a control circuit and mechanism as is known in the art.

Figure 3:
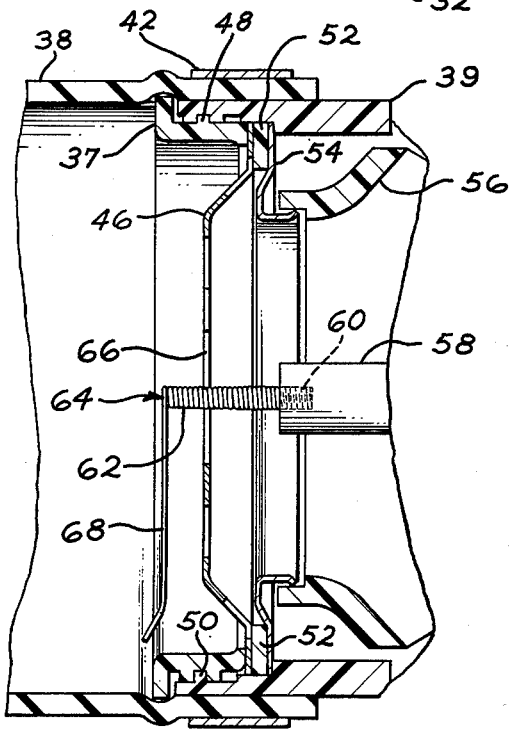
FIG. 3 is a fragmentary sectional view taken along the line 3—3 of FIG. 2.
Figure 2:
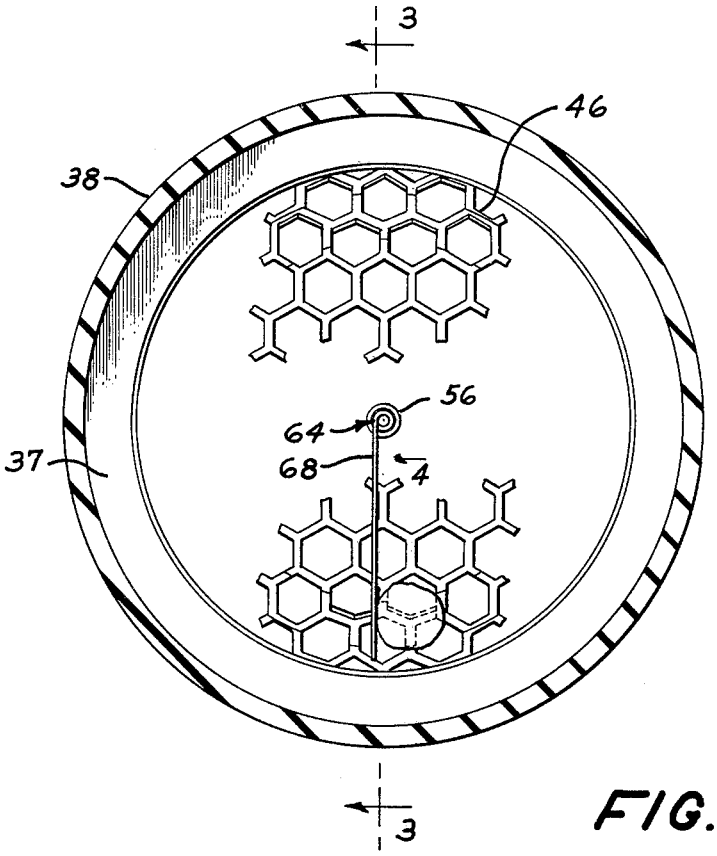
FIG. 2 is a partial sectional view taken along the line 2—2 of FIG. 1.
Figure 4:
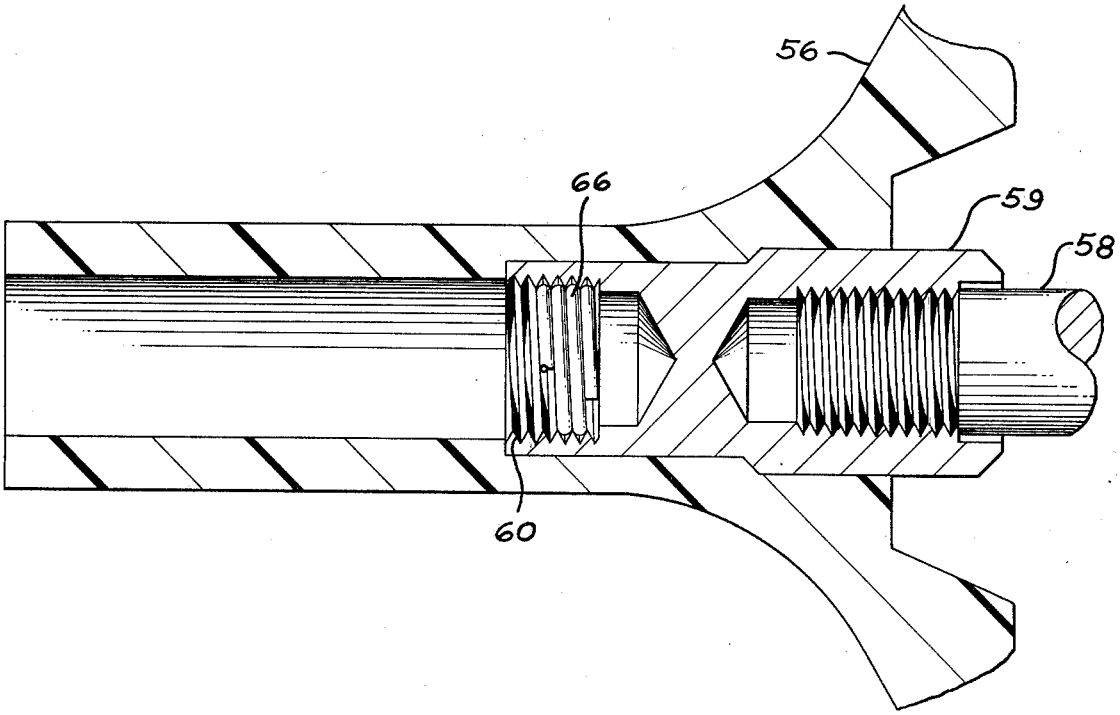
FIG. 4 is a partial cross-sectional view of an alternative embodiment of the invention.

Referring now to FIGS. 2, 3 and 4, it can be seen that pump 36 includes a housing defining an inlet within which is disposed a grid-like food particle grading element 46 through which fluid entering the pump 36 must pass. Grading element 46 is provided with peripheral collar 37 having an external screw thread 48 which cooperates with an internal screw thread 50 on the housing of pump 36.

An annular member 52 is adapted to co-act against a shoulder formed on the housing of pump 36 as grading element 46 is screwed into the pump housing. A sealing member 54 is clamped between the annular member 52 and the shoulder to provide a seal between the pump impeller 56 and the housing of the pump 36. Impeller 56 is supported by a shaft 58 and rotates therewith about an axis that is generally aligned with the housing inlet, to pump fluid through pump 36. The end of shaft 58 is provided with a threaded portion 60 (shown as an internal threaded portion in the drawing). The threads 60 are adapted to receive and cooperate with the helically-wound column 62 of food particle cutter 64. Helically-wound column 62 projects beyond the end of the shaft 58 in substantial axial alignment therewith and through a suitable orifice 66 in grading element 46 and terminates in a cutting arm 68 upstream of the grading element. It is, of course, possible that shaft 58 could extend through grading element 46 but it is critical to this invention that there be provided a helically-wound column 62 which terminates in the cutting arm 68. This criticality derives from the fact that during pump operation the cutting arm rotates upstream of and closely adjacent to grid-like grading element 46 and thereby serves as a food waste particle cutter to macerate food particles lodged thereon. The helically-wound column serves a special function in that it provides a degree of flexibility to cutting arm 68. Thus, when a rigid unmacerated particle is lodged on the grading element, the column may flex and expand, allowing the cutting arm to pass over or, in the alternative, be bent backward and slip around the particle and continue its macerating function. By providing this degree of freedom to the cutting arm, serious damage to it and shaft 58 is avoided when such unmacerable particles become lodged in the grading element 46. Normally, such unmacerable particles are repeatedly struck by cutting arm 68 until they are dislodged and caused to find their way to a collection chamber (not shown) located either in conduit 38 or pump housing 39.

In addition, it is possible to extend pump impeller 56 and secure helically wound column 62 thereto. Also it is acceptable to provide a convertor 59 (as shown in FIG. 4) affixed to the end of shaft 58 which fits inside impeller 56 and receives helically wound column 60.

It should also be noted that helically wound column 60 may be tapered, rather than cylindrical, to give a preselected degree of flexibility thereto.

It should be appreciated that the attachment of the helically wound column 62 can be effected by providing external threads on shaft 58 and suitably sizing the shaft and helical column so that the column may be threaded externally of the shaft. Similarly, shaft 58 can terminate at the pump impeller 56 which, as shown in FIG. 4, is threadedly attached thereto. It is then possible to provide threads either internally or externally on pump impeller 56 to provide for the threaded attachment of column 62 as aforementioned.

Having thus described the invention, what is claimed is:

1. A pump and motor assembly for use with a dishwasher comprising a pump housing having an inlet and an outlet, a rotatable shaft having an impeller for rotation within said housing at a preselected location to provide for pumping of fluid from said inlet toward said outlet;

a grid-like food particle grading element disposed across said inlet and having a plurality of openings through which fluid entering said inlet must pass to reach said impeller;

a food particle cutter attached to said shaft and including a cutting arm mounted on a flexible, helically-wound column, said arm being rotatable about said axis and said column being flexibly expandable to provide for said arm to pass over an unmacerable food particle lodged in one of said openings of said grading element.

2. The apparatus of claim 1 wherein said helically wound column has a threaded-like surface and said rotatable shaft includes a threaded surface to receive said column in screw-type relationship.

3. The apparatus of claim 2 wherein said threaded surface defines a hole coaxial with said shaft.

* * * * *